United States Patent [19]

Hayes

[11] 3,939,534

[45] Feb. 24, 1976

[54] WRISTBAND CONNECTOR WITH INTEGRAL PINS

[75] Inventor: Robert R. Hayes, Euclid, Ohio

[73] Assignee: Cole National Corporation, Cleveland, Ohio

[22] Filed: Jan. 28, 1975

[21] Appl. No.: 544,857

[52] U.S. Cl. ..... 24/265 B

[51] Int. Cl.[2] ..... A44C 5/18

[58] Field of Search..... 224/4 E; 24/73 WW, 265 R, 24/265 B

[56] References Cited

UNITED STATES PATENTS

| | | | |
|---|---|---|---|
| 1,242,152 | 10/1917 | Depollier | 24/265 B |
| 1,742,457 | 1/1930 | Wittman | 24/265 B |
| 2,007,538 | 7/1935 | Kraemer | 224/4 E UX |
| 2,870,511 | 1/1959 | Sand | 24/265 B |
| 2,901,806 | 9/1959 | Henshel | 24/265 B |
| 3,740,804 | 6/1973 | Levinger | 24/265 B |

FOREIGN PATENTS OR APPLICATIONS

| | | | |
|---|---|---|---|
| 117,061 | 7/1918 | United Kingdom | 224/4 E |
| 113,397 | 5/1926 | Switzerland | 24/265 B |
| 120,555 | 6/1927 | Switzerland | 24/265 B |

*Primary Examiner*—Donald A. Griffin
*Attorney, Agent, or Firm*—Fay & Sharpe

[57] ABSTRACT

A wristband connector including an outer tubular member having two radially inwardly projecting guides, one at each end of the outer tubular member. A lug slot extends from one end of the outer tubular member along part of its length. Two inner tubular members having an outside diameter slightly less than the inside diameter of the outer tubular member have a guide slot which cooperates with and slidingly receives the guide on the outer tubular member to prevent relative rotation of the inner tubular members and outer tubular member while permitting them to slide therein. One of the inner tubular members further includes a finger lug extending outwardly therefrom which slides in the lug slot in order to provide a manual means for retracting one of the inner tubular members into the outer tubular member thereby facilitating placement of the wristband connector on a wristwatch. Pins integral with and extending longitudinally outwardly from the inner tubular members engage outwardly extending arms of a wristwatch. A spring inside the outer tubular member biases the inner tubular members outwardly and a means for holding a wristband to the wristband connector is operatively attached to the outer tubular member.

5 Claims, 4 Drawing Figures

WRISTBAND CONNECTOR WITH INTEGRAL PINS

BACKGROUND OF THE INVENTION

This invention relates to wristband connectors for wristwatches.

It is often frustrating to thread a retractable pin through the tubular end opening in a wristband and subsequently insert it into the extending arms of a wristwatch case. The difficulty is encountered because the openings in the wristwatch arms in which the pin fits are hidden from view and the pin itself is covered by the wristband end. Ideally, the retractable pin should be manually controllable and readily accessible during the process of inserting it on a wristwatch. The pin should also be integral with the wristband so that it doesn't become separated during assembly. Simplicity of design and a minimum number of parts are also important to minimize cost and increase reliability.

Many different solutions have been proposed to facilitate the insertion of a wristband on a wristwatch. For example, Mathez U.S. Pat. No. 1,818,637 discloses a relatively complex device and while it uses integral sliding pins to connect a wristband, it does not appear to have any manual method of controlling them. Depoiller U.S. Pat. No. 1,242,152 shows a retractable pin having a spring biased inner tubular member and an outer tubular member with a latch thereon for manually engaging it. However, the pin is designed to be placed through a strap end and thus inaccessible for convenient manual operation. Sand U.S. Pat. No. 2,870,511 also shows a retractable pin in conjunction with a wristband. However, the Sand device is relatively difficult to manufacture because of the totally enclosed mechanism and the large number of parts.

In this invention, a relatively few components in a wristband connector are utilized to provide all of the advantages noted above and found in the prior art. That is, the wristband of this invention can be manually assembled on a wristwatch with a minimum of effort. Integral spring biased retractable pins are operable by an easily accessible finger lug. The construction of the connector uses only four basic parts and a wristband connector to achieve the above-noted advantages. This reduction in the number of parts and the retention of functions is a decided advantage in the manufacture and operation of the wristband connector. Accordingly, it has all of the advantages desired in a wristband and overcomes the problems of the prior art.

SUMMARY OF THE INVENTION

A wristband connector comprising an outer tubular member having a longitudinal slot and at least one radially inwardly projecting guide. At least one outwardly biased inner tubular member telescopes inside the outer tubular member and has a finger lug which moves in the longitudinal slot and a guide slot which cooperates with the guide on the outer tubular member. A longitudinally extending pin integral with the inner tubular member is designed to engage a wristwatch arm.

DETAILED DESCRIPTION OF THE DRAWINGS

Figure 1:
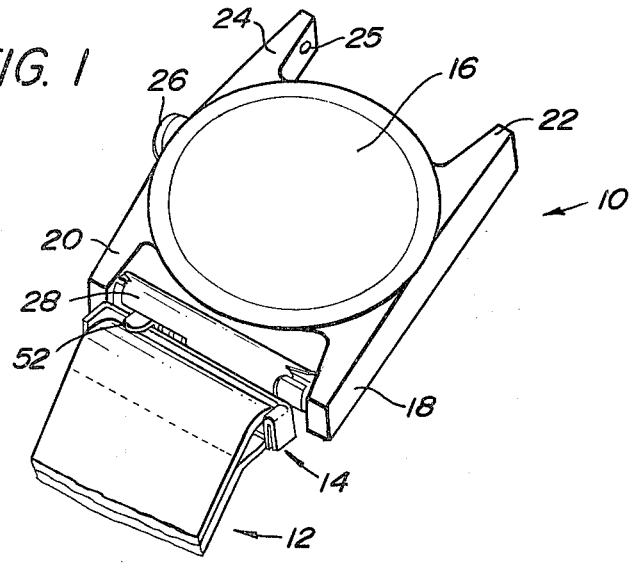
FIG. 1 is a schematic representation of the back of a wristwatch, wristband connector and wristband.
Figure 2:
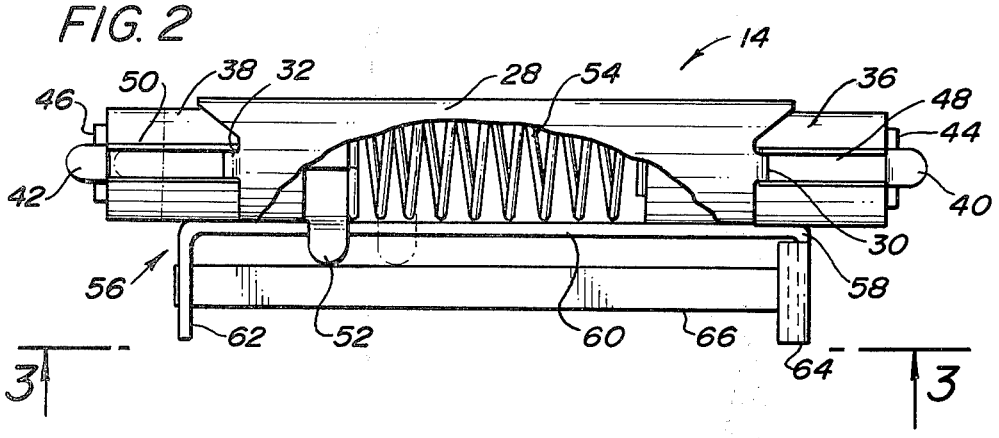
FIG. 2 is a plan view, partially cut away, of the wristband connector of this invention with the wristband and wristwatch removed.
Figure 3:
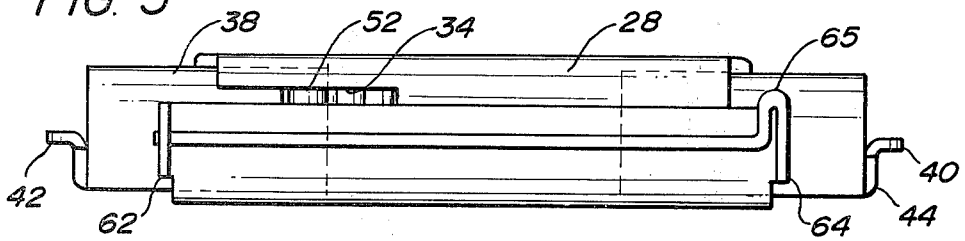
FIG. 3 is a section 3—3 of FIG. 2.
Figure 4:
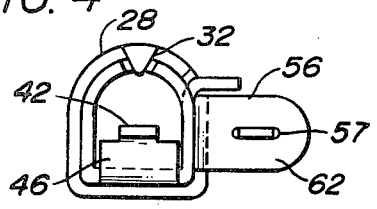
FIG. 4 is an end view of FIG. 3.

As illustrated in FIG. 1, a wristwatch 10 is connected to a wristband 12 by means of a wristband connector 14. The wristwatch includes a casing 16, and outwardly extending arms 18, 20, 22 and 24 integral therewith. Pin receptacles such as 25 are located on the inside of each arm and a stem 26 extends from the casing 16. The wristband 12 can be any known type, such as leather, vinyl, metal mesh, links or solid arcs. It is fully anticipated and within the scope of this invention that the band could also be an expandable watchband, in which case it may be integrally connected with the wristband connector 14.

As shown in FIGS. 1 through 4, the wristband connector includes an outer tubular member 28 having integral radially inwardly extending projections 30 and 32. A finger lug guide 34 includes a longitudinal slot opening outwardly at one end of the outer tubular member 28. The lug guide 34 extends along part of the length of the outer tubular member 28.

Two inner tubular members 36 and 38 each include an integral longitudinally outwardly extending pin 40 and 42, respectively. Shoulders 44 and 46 are integral with and support rounded pins 40 and 42, respectively, on the tubular members 36 and 38. The inner tubular members or blanks 36 and 38 also include longitudinal slots 48 and 50, respectively, which receive therein the projections 30 and 32 on the outer tubular member to permit relative telescopic movement of the inner tubular members 36 and 38 and the outer tubular member 28 while prohibiting rotation of the members relative to each other. This invention would also be operable with one inner tubular member and a pin extending from the opposite end of the outer tubular member to engage a wristwatch arm.

The inner tubular member 38 further includes an outwardly extending round integral finger lug 52 which moves within the lug guide 34. The finger lug 52 passes outwardly through the finger lug slot 34 of the outer tubular member 28 so that it may readily be grasped and moved manually. The finger lug's design and placement on the bottom of the wristband provides maximum strength and comfort to the wearer. The lug guide 34 extends along the outer tubular member a length sufficient to permit retraction of the pin 42 out of arm 20 of the wristwatch 10.

A resilient member such as a helical spring 54 is mounted inside the outer tubular member 28 and has its ends operatively abutting against the inside portions of the inner tubular members 36 and 38. The spring 54 is compressed by the inner tubular members 36 and 38. The thus resulting outwardly biased, inner tubular members 36 and 38 are held from ejection out of the ends of the outer tubular member 28 by the projections 30 and 32 abutting against the ends of slots 48 and 50, respectively.

A means for holding 56 the wristband 12 is operatively attached to the outer tubular member 28 and includes a U-shaped member 58 having a base 60 and radially outwardly extending ears 62 and 64. Between the ears 62 and 64 is a connecting bar 66 having one end 65 integral with the ear 64 and the other inserted in a slot 57 in the ear 62. The end 65 is U-shaped to permit resilient movement of the bar 66. It is anticipated that the connecting bar 66 may be pivotal or otherwise moveable to permit removal of the wristband 12.

In operation, the use of the wristband connector 14 is extremely convenient. The readily accessible finger lug 52 is utilized to retract the pin 42 and after locating the pin 42 to move into the receptacle 25, the finger lug 52 is released. There is no possibility of dropping a loose pin. Equally important is the reduction in the number of parts while performing the same function. By properly cutting and forming the inner tubular members, they include an integral pin, shoulder, guide slot and finger lug. Similarly, the outer tubular member includes integral projections and a lug slot.

Variations in some of the design will be obvious to those skilled in the art, however, such changes are anticipated and included within the scope of this invention.

The invention claimed is:

1. A wristband connector comprising:

an outer tubular member having at least one radially inwardly extending projection near an end of the tubular member and a lug slot which extends longitudinally along the outer tubular member;

at least one inner tubular member having an outside diameter slightly less than the inside diameter of the outer tubular member, said inner tubular member having a guide slot which cooperates with and slidably receives the projection to prevent relative rotation of the inner tubular member and outer tubular member while permitting the inner tubular member to telescope inside the outer tubular member;

the inner tubular member further including a finger lug extending outwardly therefrom which slides inside the lug slot in order to provide a means for moving the inner tubular member while in the outer tubular member;

a pin integral with and extending longitudinally outwardly from the inner tubular member so that the wristband connector may engage a receptacle in a wristband, biasing means inside the outer tubular member and secured between the outer tubular member and inner tubular member to bias outwardly the inner tubular member; and means for holding one end of a wristband spaced from the outer tubular member, said means for holding being operatively attached to the outer tubular member.

2. The wristband connector of claim 1 wherein the biasing means includes a spring and the finger lug.

3. The wristband connector of claim 2 which includes two inner tubular members, one at each end of the outer tubular member, each inner tubular member having a guide slot which cooperates with and slidingly receives a radially inwardly extending projection on the outer tubular member to prevent rotation of the inner tubular members and outer tubular member while permitting both tubular members to slide inside the outer tubular member, both inner tubular members further including a pin integral with and extending longitudinally outwardly therefrom so that the wristband connector may engage complementary openings in a wristwatch, the spring inside the outer tubular member having its ends operatively engaged to the inner tubular members so that they are biased outwardly from the outer tubular member.

4. The wristband connector of claim 3 wherein the means for holding the wristband further includes a U-shaped member having a base and two ears extending therefrom, the base being attached to the outer tubular member and the ears extending radially outwardly from the outer tubular member, an integral connecting bar attached to one ear of the U-shaped member and, the other end of the integral connecting bar cooperating with a complementary slot in the other ear.

5. The wristband connector of claim 3 wherein the finger lug and pin are integral with the inner tubular member and the inwardly extending projections are integral with the outer tubular member.

* * * * *